US008062064B2

(12) United States Patent
Rodrigues et al.

(10) Patent No.: US 8,062,064 B2
(45) Date of Patent: Nov. 22, 2011

(54) MODULAR NUT ASSEMBLY HAVING TEXTURED RING

(75) Inventors: Julio Rodrigues, Collierville, TN (US); Harold Watkins, Horseheads, NY (US); Daniel Fitzwater, Gillett, PA (US); William Thomas Young, Elmira, NY (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 12/767,066

(22) Filed: Apr. 26, 2010

(65) Prior Publication Data

US 2010/0285691 A1 Nov. 11, 2010

Related U.S. Application Data

(60) Provisional application No. 61/177,008, filed on May 11, 2009.

(51) Int. Cl.
*H01R 9/05* (2006.01)

(52) U.S. Cl. ..... 439/578

(58) Field of Classification Search ..... 439/478–485
See application file for complete search history.

(56) References Cited

U.S. PATENT DOCUMENTS

| | | | | |
|---|---|---|---|---|
| 4,076,367 | A * | 2/1978 | Avins | 439/583 |
| 4,519,661 | A * | 5/1985 | Brush et al. | 439/312 |
| 4,984,995 | A * | 1/1991 | Tucker et al. | 439/321 |
| 5,145,394 | A * | 9/1992 | Hager | 439/321 |
| 6,190,616 | B1 * | 2/2001 | Jovanovich et al. | 422/538 |
| 6,551,839 | B2 * | 4/2003 | Jovanovich et al. | 436/180 |
| 7,427,215 | B2 * | 9/2008 | Heckmann et al. | 439/607.41 |
| 7,431,602 | B2 * | 10/2008 | Corona | 439/272 |
| 2010/0022120 | A1 * | 1/2010 | Bradley | 439/578 |

OTHER PUBLICATIONS

U.S. Appl. No. 29/308,029, filed May 23, 2008, Malloy.

* cited by examiner

*Primary Examiner* — Chandrika Prasad
(74) *Attorney, Agent, or Firm* — Foley & Lardner LLP

(57) ABSTRACT

A modular nut assembly includes a substantially cylindrical body portion having a threaded interior surface and an exterior surface. The exterior surface includes a first portion configured for engagement by a mechanical tool and a second portion. A textured ring is configured for engagement by a hand of a user, wherein the second portion is configured to receive the textured ring.

20 Claims, 4 Drawing Sheets

MODULAR NUT ASSEMBLY HAVING TEXTURED RING

CROSS-REFERENCE TO RELATED APPLICATION

This application claims priority under 35. U.S.C. §119, based on U.S. Provisional Patent Application No. 61/177,008 filed May 11, 2009, the disclosure of which is hereby incorporated by reference herein.

BACKGROUND OF THE INVENTION

Connectors are used to connect coaxial cables to various electronic devices, such as televisions, antennas, set-top boxes, satellite television receivers, etc. Conventional coaxial connectors generally include a connector body having an annular collar for accommodating a coaxial cable, an annular nut rotatably coupled to the collar for providing mechanical attachment of the connector to an external device, and an annular post interposed between the collar and the nut. The annular collar that receives the coaxial cable includes a cable receiving end for insertably receiving a coaxial cable and the annular nut includes an internally threaded end that permits screw threaded attachment of the body to an external device.

Conventional coaxial cables typically include a center conductor surrounded by an insulator. A conductive foil is disposed over the insulator and a braided conductive shield surrounds the foil-covered insulator. An outer insulative jacket surrounds the shield. In order to prepare the coaxial cable for termination with a connector, the outer jacket is stripped back exposing a portion of the braided conductive shield. The exposed braided conductive shield is folded back over the jacket. A portion of the insulator covered by the conductive foil extends outwardly from the jacket and a portion of the center conductor extends outwardly from within the insulator.

Upon assembly, a coaxial cable is inserted into the cable receiving end of the connector body and the annular post is forced between the foil covered insulator and the conductive shield of the cable. A locking sleeve is then moved axially into the connector body to clamp the cable jacket against the post. The connector can then be attached to an external device by tightening the internally threaded nut to an externally threaded terminal or port of the external device.

DETAILED DESCRIPTION OF THE PREFERRED EMBODIMENTS

A large number of home coaxial cable installations are often done by "do-it yourself" laypersons who may not be familiar with torque standards associated with cable connectors. In these cases, the installer will typically hand-tighten the coaxial cable connectors instead of using a tool. As described briefly above, conventional cable connectors typically include an annular nut rotatably coupled to the connector for facilitating connection of the cable connector to a mating terminal. The annular nut typically has a hexagonal surface for receiving a wrench or other similar tool or mechanical device. Unfortunately, hand-tightening of a hex nut (or similar wrench-tightened nut configuration) may not provide sufficient torque to properly seat the connector with the terminal, or the nut may be difficult to tighten by hand.

Implementations consistent with embodiments described herein may provide for increased usability and cost-effectiveness by providing a modular, annular nut assembly for facilitating connection of a cable connector to a mating terminal. In one exemplary implementation, an annular nut assembly may include a body portion and a textured ring connected or attached around the body portion. The body portion may include surfaces suitable for engagement by a wrench or similar mechanical tool. The textured ring may be lockingly mounted relative to the body portion and may include a textured surface suitable for facilitating hand tightening of the nut.

Figure 1:
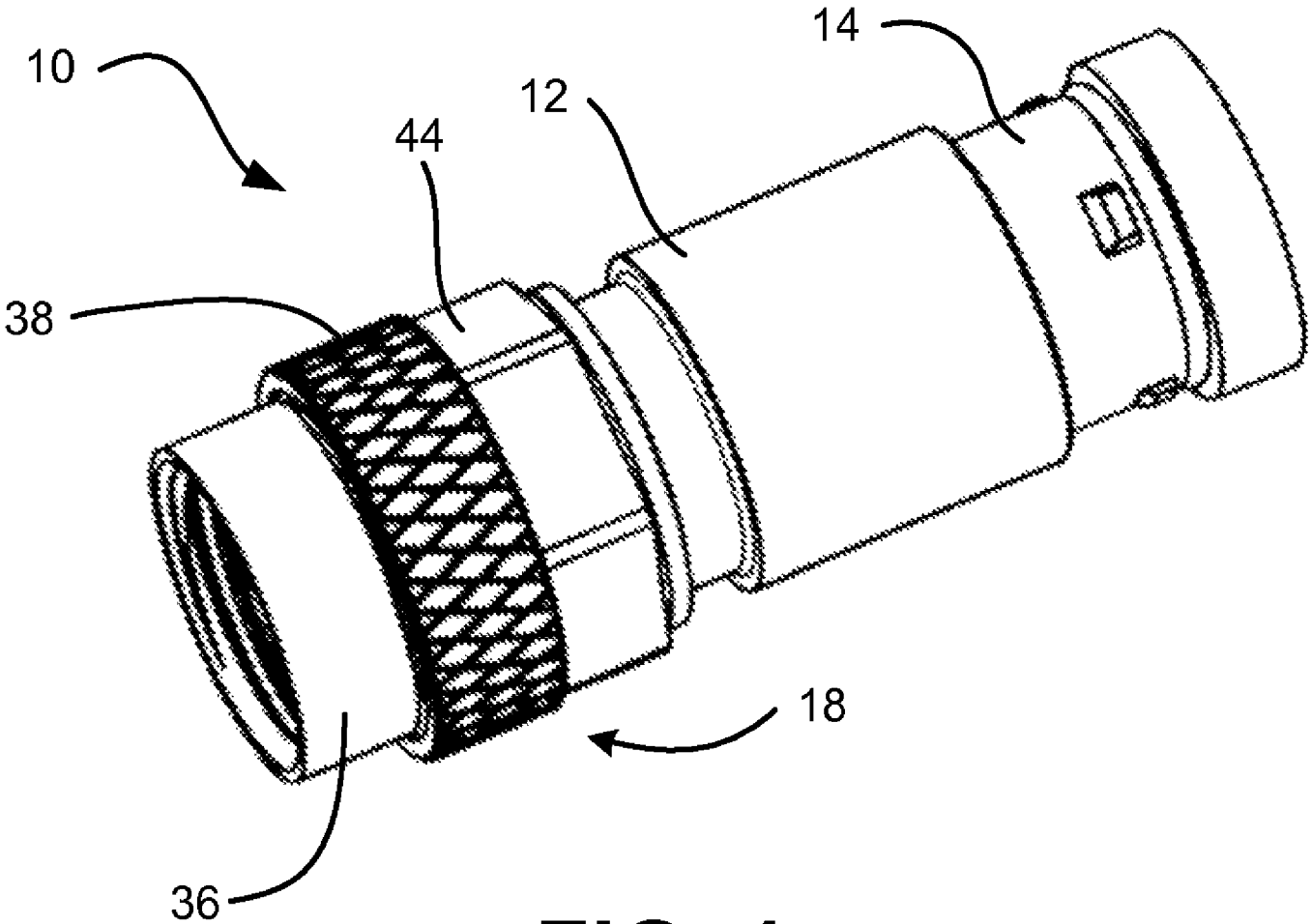
FIG. 1 is an isometric view of an exemplary embodiment of a coaxial cable connector.
Figure 2:
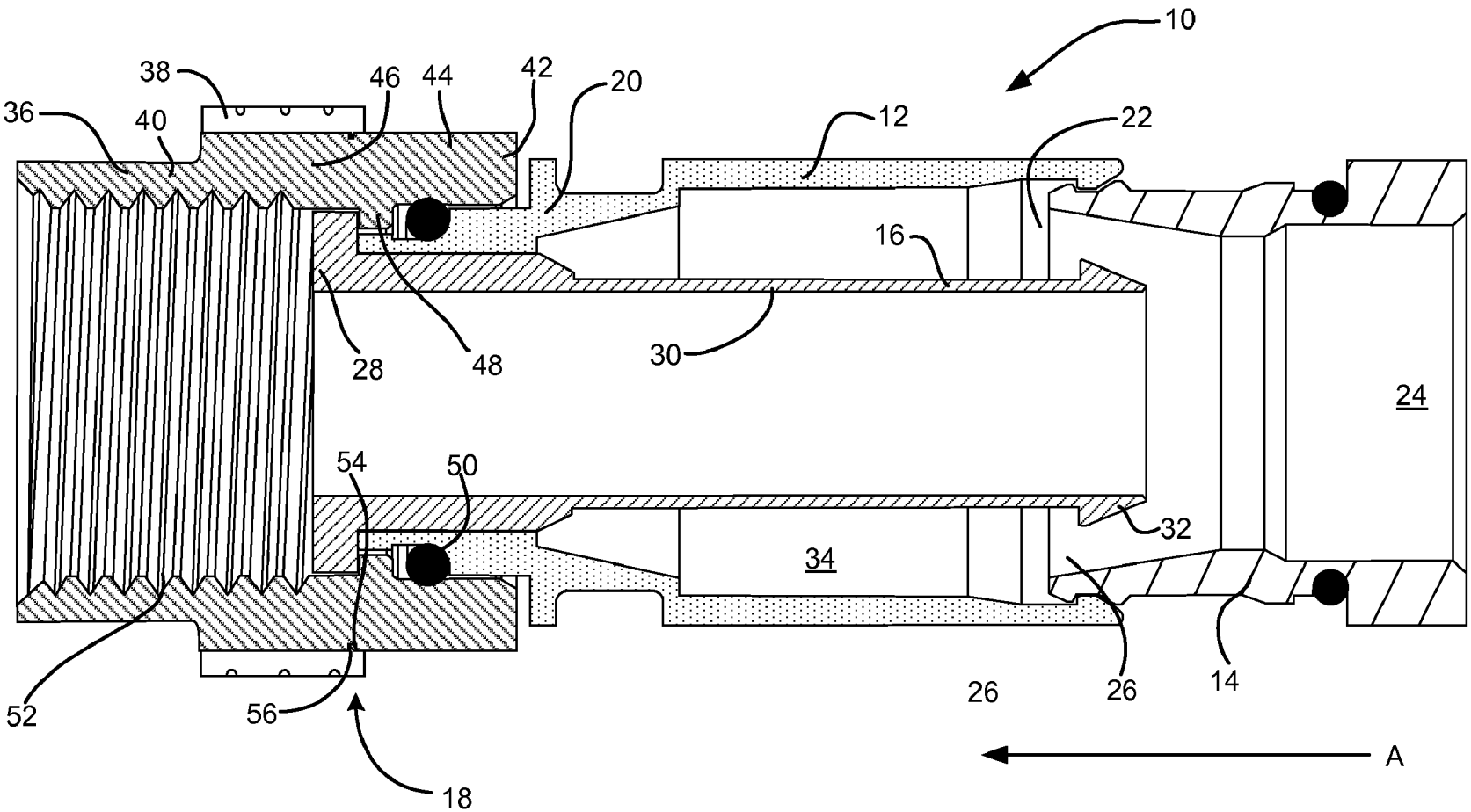
FIG. 2 is a cross-sectional view of the coaxial cable connector of FIG. 1.

FIGS. 1-3 depict an exemplary coaxial cable connector 10 consistent with embodiments described herein. As illustrated, connector 10 may include a connector body 12, a locking sleeve 14, an annular post 16 (not visible in FIG. 1), and a rotatable nut assembly 18.

In one implementation, connector body 12 (also referred to as a "collar") may include an elongated, cylindrical member, which can be made from plastic, metal, or any suitable material or combination of materials. Connector body 12 may include a forward end 20 operatively coupled to annular post 16 and rotatable nut 18, and a cable receiving end 22 opposite to forward end 20. Cable receiving end 22 may be configured to insertably receive locking sleeve 14, as well as a prepared end of a coaxial cable in the forward direction as shown by arrow A in FIG. 2.

Locking sleeve 14 may include a substantially tubular body having a rearward cable receiving end 24 and an opposite forward connector insertion end 26, movably coupled to connector body 12. Upon assembly of connector 10, locking sleeve 14 may be lockingly axially moveable along the direction of arrow A toward the forward end 20 of the connector body 12 from a first position, as shown, for example, in FIG. 2 to a second, axially advanced position (not shown). When in the first position, locking sleeve 14 may be loosely retained in connector 10. When in the second position, locking sleeve 14 may be secured within connector 10.

As mentioned above, connector 10 may further include annular post 16 coupled to forward end 20 of connector body 12. As illustrated in FIG. 2, annular post 16 may include a flanged base portion 28 at its forward end for securing the post within annular nut assembly 18. Annular post 16 may also include an annular tubular extension 30 extending rearwardly within body 12 and terminating adjacent rearward end 22 of connector body 12. In one embodiment, the rearward end of tubular extension 30 may include a radially outwardly extending ramped flange portion or "barb" 32 to enhance compression of the outer jacket of the coaxial cable and to secure the cable within connector 10. Tubular extension 30 of annular post 16, locking sleeve 14, and connector body 12 together define an annular chamber 34 for accommodating the jacket and shield of an inserted coaxial cable.

As illustrated in FIGS. 1-3, annular nut assembly 18 may be rotatably coupled to forward end 20 of connector body 12 for providing mechanical attachment of the connector 10 to an external device via a threaded relationship. Consistent with implementations described herein, annular nut assembly 18 may include a modular configuration that includes a body portion 36 and a textured ring 38 coupled to body portion 36.

Figure 3A:
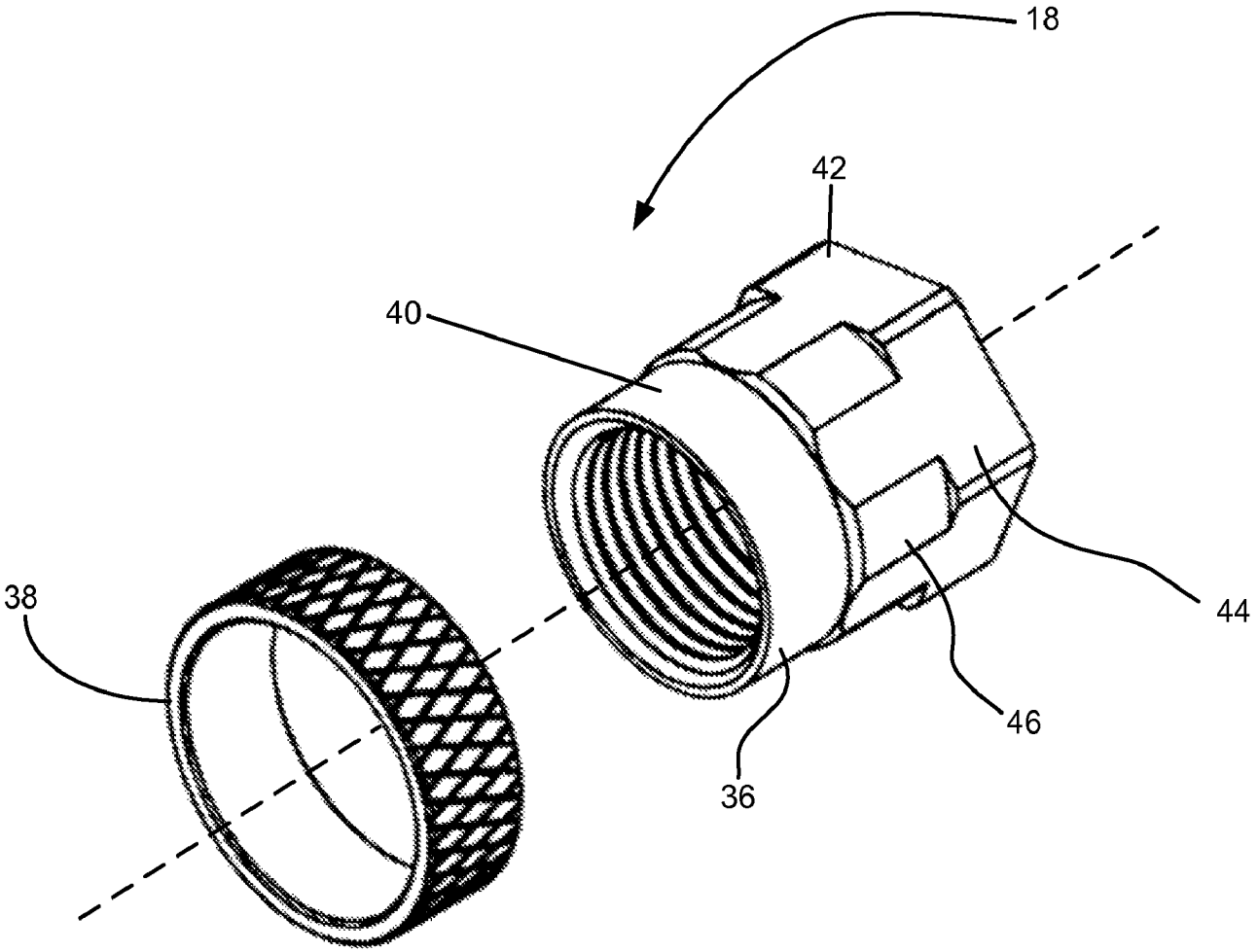
FIGS. 3A and 3B are exploded isometric views of the nut assembly of the coaxial cable connector of FIG. 1.
Figure 3B:
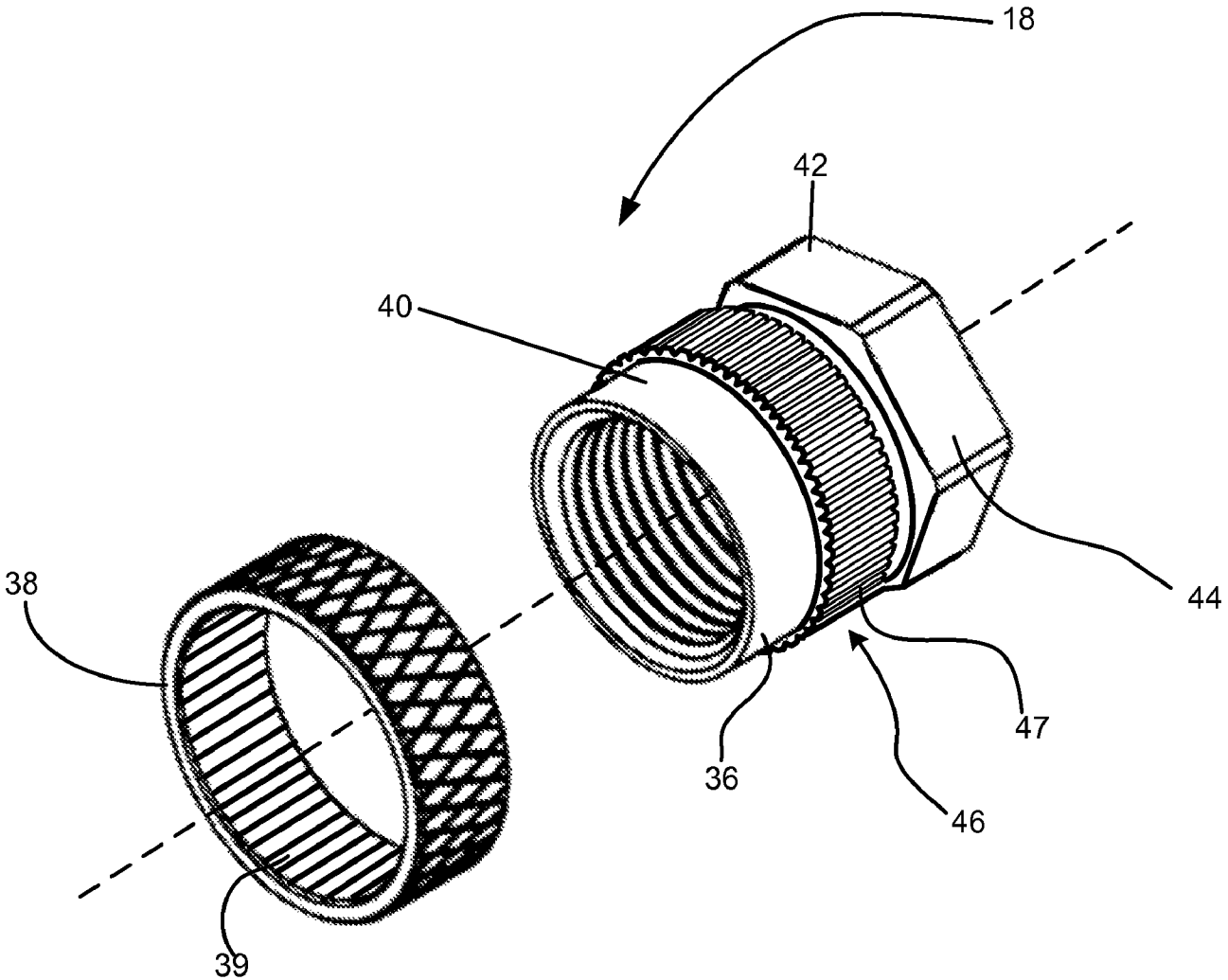

Body portion 36 may include a substantially tubular body having a forward portion 40 and a rearward portion 42, as illustrated in FIGS. 3A and 3B. Rearward portion 42 may be further configured to include an external angled surface portion 44 formed integrally with body portion 36. External angled surface portion 44 may include a number of angled surfaces suitable for engagement by a wrench or similar torque application device. Rearward portion 42 may further include a textured ring engagement portion 46 for lockingly receiving textured ring 38. In one exemplary implementation, angled surface portion 44 may include a substantially hexagonal (i.e., 6-sided) or double hexagonal (i.e., 12-sided) configuration for facilitating tightening/loosening engagement by an SAE (Society of Automotive Engineers) wrench or metric wrench, or any other suitable wrench or tool.

Textured ring engagement portion 46 may be configured to receive textured ring 38 thereon. As illustrated in FIG. 3A, textured ring engagement portion 46 may include angled surfaces configured to allow textured ring 38 to be inserted thereon, yet structured to prevent or inhibit rotational movement of textured ring 38 relative to body portion 36 upon insertion. For example, flat surfaces may project forward from each of the external angled surfaces. The flat surfaces may be connected by curved surfaces having an outside diameter substantially similar to the inside diameter of textured ring 38. In such a configuration, the edges formed between the flat surfaces and the curved surfaces may operate to prevent rotation of textured ring 38 relative to body portion 36.

In another exemplary implementation, as illustrated in FIG. 3B, textured ring engagement portion 46 may include a keyed structure for engagement with a mating keyed structure on an interior of textured ring 38. For example, textured ring 38 may include a keyed portion, such as grooves or notches 39, extending from its inside diameter. Textured ring engagement portion 46 may include a matching key receiving portion in its outside diameter for preventing textured ring 38 from rotating relative to body portion 36 upon assembly. For example, textured ring engagement portion 46 may include a number of keyed grooves 47 formed axially on an exterior surface. The interaction between textured ring 38 and textured ring engagement portion 46 may prevent both axial and rotational movement of texture ring 38 relative to body portion 38.

Body portion 36 may further include an annular flange 48 configured to fix nut assembly 18 axially relative to annular post 16 and connector body 12. In one implementation, a resilient sealing O-ring 50 may be positioned between annular nut assembly 18 and connector body 12 to provide a water resistant seal between connector body 12, annular post 16, and annular nut 18. Body portion 36 may include internal threads 52 for engaging matching external threads provided on a mating terminal.

As illustrated in FIGS. 2 and 3, textured ring 38 may be substantially cylindrical and may include an inside diameter similar to an outside diameter of textured ring engagement portion 46. Textured ring 38 may include an external textured surface configured to facilitate hand tightening and loosening of nut assembly 18. For example, the textured surface may include a knurled pattern formed into an outer surface of textured ring 38. In another implementation, textured ring 38 may include a grooved pattern or a pattern including one or more raise ridges, e.g., a pebbled or ridged pattern.

In exemplary implementations, textured ring 38 may be formed of any suitable material, such as metal, plastic, or any suitable material or combination of materials. Furthermore, textured ring 38 may be provided in a variety of different colors or appearances different from connector body 12 for the purposes of product differentiation or marking. In one implementation, body portion 36 may be formed of metal and textured ring 38 may be formed of a plastic, resin, or rubber having a different visual appearance from body portion 36.

During assembly, textured ring 38 may be inserted onto textured ring engagement portion 46 of body portion 36. As described above, the locking structure of textured ring 38 and textured ring engagement portion 46 may facilitate insertion of textured ring 38 onto textured ring engagement portion 46 while preventing relative rotational movement therebetween.

In one implementation, textured ring 38 may be coupled to body portion 36 via a snap-fit or press-fit mechanism. As illustrated in FIG. 2, textured ring engagement portion 46 may include a groove 54 for receiving a mating ring 56 in textured ring 38. Upon assembly of connector 10, ring 56 may be received in groove 54 and may prevent or inhibit disassembly of textured ring 38 from body portion 36.

In another exemplary implementation, textured ring 38 may be formed of molded plastic or plastic resin formed in place about textured ring engagement portion 46 in an overmolding procedure. In this implementation, textured ring 38 is not inserted onto textured ring engagement portion 46 during assembly.

Connector 10 may be supplied in the assembled condition, as shown in the drawings, in which locking sleeve 14 is pre-installed inside rearward cable receiving end 22 of connector body 12. In such an assembled condition, a coaxial cable may be inserted through rearward cable receiving end 30 of locking sleeve 14 to engage annular post 16 of connector 10 in the manner described above. In other implementations, locking sleeve 14 may be first slipped over the end of a coaxial cable and the cable (together with locking sleeve 14) may subsequently be inserted into rearward end 22 of connector body 12.

In either case, once the prepared end of a coaxial cable is inserted into connector body 12 so that the cable jacket is separated from the insulator by the sharp edge of annular post 16, locking sleeve 14 may be moved axially forward in the direction of arrow A from the first position to the second position. In some implementations, advancing locking sleeve 14 from the first position to the second position may be accomplished with a suitable compression tool. As locking sleeve 14 is moved axially forward, the cable jacket is compressed within annular chamber 34 to secure the cable in connector 10. Once the cable is secured, connector 10 is ready for attachment to a port connector, such as an F-81 connector, of an external device.

To facilitate attachment of connector 10 to the port connector of an external device, the port connector may be inserted into the forward opening of annular nut assembly 18. Subsequent hand tightening of nut assembly 18 via textured ring 38 or wrench tightening via angled surface portion 44 may cause the port connect and post 16 to move axially together, thereby facilitating electrical and RF communication therebetween.

The above-described connector may pass electrical and RF signals typically found in CATV, satellite, closed circuit television (CCTV), voice of Internet protocol (VoIP), data, video, high speed Internet, etc., through the mating ports (about the connector reference planes).

An annular nut assembly is provided that includes both a textured portion suitable for hand tightening and an angled portion suitable for wrench tightening. Further, by providing a modular nut assembly, manufacturing costs may be significantly reduced. For example, consistent with implementations described above, body portion 36 may be machined from a single piece of hexagonal stock, thereby avoiding additional machining and fabrication costs. In addition, the modular nature of the proposed nut assembly may facilitate color and/or appearance differentiation between the textured portion and the connector body.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to a coaxial cables and connectors for securing coaxial cables. In other implementations, features described herein may be implemented in relation to other cable or interface technologies. For example, the coaxial cable connector described herein may be used or usable with various types of coaxial cable, such as 50, 75, or 93 ohm coaxial cable, or other characteristic impedance cable designs. In addition, the modular nut assembly described above may be used with any type of nut that may require hand and/or tool tightening.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

For example, although the above description references a modular nut assembly for use in connection with a coaxial cable connector, it should be understood that the described modular nut assembly may be incorporated into a variety of implementations, such as other types of nuts, connectors, etc.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A modular nut assembly, comprising:

a substantially cylindrical body portion having a threaded interior surface and an exterior surface and an end for attachment to a mating connector, wherein the exterior surface includes:

a first portion configured for engagement by a mechanical tool; and a second portion closer to the end than the first portion; and a textured ring configured for engagement by a hand of a user, wherein the second portion is configured to receive the textured ring.

2. The modular nut assembly of claim 1, wherein the first portion includes a number of angled surfaces.

3. The modular nut assembly of claim 1, wherein the first portion comprises a hexagonal or double hexagonal configuration.

4. The modular nut assembly of claim 1, wherein the second portion is configured to lockingly receive the textured ring.

5. The modular nut assembly of claim 4, wherein the second portion is configured to lockingly receive the textured ring via a press-fit or snap-fit configuration.

6. The modular nut assembly of claim 4, wherein the second portion is configured to lockingly receive the textured ring via a keyed configuration.

7. The modular nut assembly of claim 1, wherein the textured ring includes a knurled outer surface.

8. The modular nut assembly of claim 1, wherein the textured ring is visually different from the body portion.

9. A coaxial cable connector for coupling a coaxial cable to a mating connector, the coaxial cable connector comprising:

a connector body having a forward end and a rearward cable receiving end for receiving a cable; and a modular nut assembly rotatably coupled to the forward end of the connector body and an end for attachment to a mating connector, wherein the modular nut assembly comprises:

a first exterior portion configured for engagement by a mechanical tool, the first exterior portion formed integrally with a body of the modular nut assembly, and a textured ring coupled to the body of the modular nut assembly closer to the end than the first exterior portion, wherein the textured ring is configured for engagement by a hand of a user.

10. The coaxial cable connector of claim 9, wherein the first exterior portion includes a number of angled surfaces.

11. The coaxial cable connector of claim 9, wherein the textured ring is lockingly coupled to a second exterior portion of the body.

12. The coaxial cable connector of claim 11, wherein the second exterior portion is configured to lockingly receive the textured ring via a press-fit or snap-fit configuration.

13. The coaxial cable connector of claim 11, wherein the second exterior portion is configured to lockingly receive the textured ring via a keyed configuration.

14. The coaxial cable connector of claim 9, wherein the textured ring includes a knurled or grooved outer surface.

15. The coaxial cable connector of claim 9, wherein the textured ring is formed of plastic and the connector body is formed of metal.

16. A coaxial cable connector, comprising:

a connector body having a forward end and a rearward cable receiving end for receiving a cable therein; and a nut assembly rotatably coupled to the forward end of the connector body and having an end for attachment to a mating connector, wherein the nut assembly comprises:

a mechanical engagement portion configured for engagement by a mechanical tool, and a textured ring portion configured for engagement by a hand of a user, wherein the textured ring portion is located closer to the end than the mechanical engagement portion.

17. The coaxial cable connector of claim 16, wherein the nut assembly further comprises a nut body, wherein the mechanical engagement portion is formed integrally with the nut body.

18. The coaxial cable connector of claim 17, wherein the textured ring portion engages the nut body at a position different from the mechanical engagement portion.

19. The coaxial cable connector of claim 16, wherein the textured ring portion engages the nut body via a press-fit or snap-fit configuration.

20. The coaxial cable connector of claim 16, wherein the textured ring portion includes a knurled or grooved outer surface.

* * * * *